US005414231A

United States Patent [19]

Sato et al.

[11] Patent Number: 5,414,231

[45] Date of Patent: May 9, 1995

[54] SWITCH DEVICE

[75] Inventors: Hiroshi Sato; Nobuaki Ohashi, both of Saitama, Japan

[73] Assignee: Tokyo Denso Kabushiki Kaisha, Tokyo, Japan

[21] Appl. No.: 204,459

[22] Filed: Mar. 2, 1994

[30] Foreign Application Priority Data

Mar. 15, 1993 [JP] Japan ..... 5-011104 U
Mar. 15, 1993 [JP] Japan ..... 5-011105 U
Apr. 28, 1993 [JP] Japan ..... 5-022698 U

[51] Int. Cl.[6] ..... H01H 9/00; H01H 15/00

[52] U.S. Cl. ..... 200/1 R; 200/5 R; 200/16 D; 200/315; 200/339

[58] Field of Search ..... 200/1 R, 5 R, 5 A, 6 R, 200/6 B, 6 BA, 6 BB, 6 C, 16 R–16 F, 512–517, 329–345, 315, 316

[56] References Cited

U.S. PATENT DOCUMENTS 3,829,634 8/1974 Levasseur .
3,974,346 8/1976 Keprda ..... 200/5 B
4,029,914 6/1977 Schmidt et al. ..... 200/1 R
4,445,009 4/1984 Suzuki et al. ..... 200/5 R
4,912,289 3/1990 Lauritsen et al. ..... 200/1 R
5,063,479 11/1991 Satoh ..... 200/315 X
5,130,501 7/1992 Maeda ..... 200/50 C
5,130,506 7/1992 Zuercher et al. ..... 200/553
5,149,924 9/1992 Priesemuth ..... 200/5 R

FOREIGN PATENT DOCUMENTS 0138136 10/1984 European Pat. Off. .
2-106651 8/1990 Japan .
3-80938 8/1991 Japan .
1040653 6/1964 United Kingdom .
1247314 2/1970 United Kingdom .
1383020 12/1972 United Kingdom .

*Primary Examiner*—J. R. Scott
*Attorney, Agent, or Firm*—Armstrong, Westerman, Hattori, McLeland & Naughton

[57] ABSTRACT

A switch device is proposed which includes a plurality of stationary contacts fixedly formed on an insulating substrate, a plurality of movable contacts capable of sliding on the insulating substrate for independently contacting with and separating from the stationary contacts, a common holder case fixed to the insulating substrate, and positioning member provided between the insulating substrate and the holder case for positioning the insulating substrate and the holder case relative to each other. The movable contacts are supported slidably so as to be brought into and out of contact with the stationary contact in a switching manner. Thus, the positioning of the movable contacts relative to the stationary contact is extremely easy, thereby providing an improved assembling efficiency.

9 Claims, 11 Drawing Sheets

SWITCH DEVICE

BACKGROUND OF THE INVENTION

1. Field of the Invention

The present invention relates to a device comprising an insulating substrate, a plurality of stationary contacts fixedly formed on the insulating substrate, and a plurality of movable contacts capable of moving along a surface of the insulating substrate for independently contacting with and separating from the stationary contacts.

2. Description of the Prior Art

In such a prior art switch device, movable contacts capable of being independently brought into and out of contact with stationary contacts are disposed independently relative to the stationary contacts.

With such a construction as in the prior art, however, in mounting pluralities of the movable and stationary contacts, it is necessary to position the movable and stationary contacts a plurality of times during assembling and hence, the assembling efficiency is not excellent.

SUMMARY OF THE INVENTION

It is an object of the present invention to provide a switch device, wherein the positioning of a plurality of movable contacts and stationary contacts individually corresponding to the movable contacts can be performed at one time to provide an improved assembling efficiency.

To achieve the above object, according to the present invention, there is provided a switch device comprising an insulating substrate, a plurality of stationary contacts fixedly formed on the insulating substrate, a plurality of movable contacts capable of moving along a surface of the insulating substrate for independently contacting with and separating from the stationary contacts, a common holder case fixed to the insulating substrate, and positioning means provided between the insulating substrate and the holder case for positioning the insulating substrate and holder case, the movable contacts being slidably supported in the holder case so as to be brought into and out of contact with the corresponding stationary contacts in a switching manner.

With the above construction, the relative positions of the movable contacts relative to the stationary contacts are definitely determined at one time through the positioning means by securing the holder case to the insulating substrate. Thus, it is possible to extremely facilitate the positioning operation, leading to an improved assembling efficiency.

In addition to the construction proposed above, if the movable contacts are provided on contact holders slidably retained in the holder case, respectively, the movable contacts can previously be mounted to the contact holders without damaging the movable contacts.

Further, in addition to the construction proposed above, the switch device may further include two pairs of projected portions which are projected in each pair, at a distance from the other pair, from opposite sides of each of the contact holders, and guide portions provided on the holder case along a direction of sliding movement of each contact holder for guiding the projected portions. With this construction, it is possible to relatively reduce the slide resistance attendant on the sliding movement of the contact holder within the holder case.

Yet further, if the positioning means is comprised of a pair of projections provided on the holder case, and a pair of holes which are provided in the insulating substrate and in which the projections are fitted, it is possible to position the holder case and the insulating substrate in a simple construction.

Yet further, in addition to the construction proposed above, the switch device may further include a casing for supporting a plurality of operating members capable of returning to neutral positions thereof in response to an operating force being released, and a board assembly positioned and fixed in the casing, the board assembly comprising the insulating substrate, a plurality of contact holders which are respectively provided with the movable contacts exhibiting a resilient force toward the insulating substrate and which are inserted into and engaged with the operating members, and the holder case for holding the contact holders such that the contact holders are slid in response to an operation of the operating members. With such a construction, the relative positions of the movable contacts relative to the plurality of stationary contacts are determined definitely, and moreover, the neutral position of each of the contact holders in the board assembly can be maintained by the resilient force of the movable contact. Therefore, as a result of positioning and fixing of the board assembly to the casing, the connection of the operating members to the contact holders is performed simultaneously. This leads to an improved assembling operation efficiency.

Further, in addition to the above construction, the switch device may further include operating knobs provided in the casing for applying an operating force to the operating members, and light guides provided in the insulating substrate for transferring light from light-emitting elements to the operating knobs to bring about irradiation of the operating knobs, the holder case and the light guides being fixed to the insulating substrate by common screw means. The inclusion of the light guide in the board assembly makes it possible to improve the assembling operation and to easily position the light guides relative to the operating knobs.

Further, the contact holder may be provided with projected portions which are projected toward opposite sides, the holder case may be provided with a guide portion for guiding a sliding operation of the contact holder, the guide portion comprising side guide portions opposed to the projected portions from a side of the insulating substrate, and an upper guide portion opposed to the contact holder from a side opposite the insulating substrate, one of the projected portions and the side guide portions may be provided with a positioning projection projected therefrom, the other of the projected portions and the side guide portion may be provided with a positioning recess in which the positioning projection is fitted so as to hold the contact holder at a position wherein the operating member in its neutral position can be inserted into the contact holder, and wherein a distance between the upper and side guide portions may be set such that the positioning projection is disengaged from the positioning recess when the contact holder is brought into slide contact with the upper guide portion. With this construction, it is possible to retain the contact holders in their neutral positions when assembling the holder case and insulating substrate, and such neutral positions of the contact holders can be retained by the resilient force of the movable contact in a state where the holder case is fixed to the insulating substrate. Therefore, when assembling the holder case to the casing, the operating members can easily be connected to the contact holders, and the sliding resistance of the contact holders in the holder case can be suppressed to a small level.

Yet further, in addition to the construction proposed above, the movable contacts may be held by contact holders which are slidably carried in the holder case, and each of the movable contacts may comprise a base portion fixed to the contact holder, and a plurality of resilient contact portions exhibiting a resilient force toward the insulating substrate and commonly and continuously connected to the base portion with different spring constants. With such a construction, when the resilient contact portions are moved onto and down the stationary contact slightly raised from the insulating substrate, the sliding of at least one of the resilient contact portions can be maintained to prevent the generation of chattering during switching ON or OFF.

Yet further, in addition to the construction proposed above, the switch device may include a casing which comprises a support plate portion on which is carried an operating member which is operatable in response to an operation to bring about sliding of the movable contacts, and a wall continuously connected to a peripheral edge of the support plate portion, the casing including a plurality of bosses projectingly provided on an inner surface of the support plate portion so as to be distanced from an inner surface of the wall, the insulating substrate being fixed to the bosses by screw means with a gap formed between an outer peripheral edge of the insulating substrate and the inner surface of the wall of the casing. With such a construction, it is possible to avoid the application of a load from the casing to the insulating substrate to the utmost to prevent a strain from being generated in the insulating substrate and to prevent the stationary contacts from being broken.

Further, if the number of the bosses is at most three, it is possible to prevent a strain of the insulating substrate to the utmost during screwing, while insuring the positioning of the insulating substrate in the casing, and to reliably prevent the generation of the strain in the insulating substrate.

Yet further, in addition to the construction proposed above, the movable contacts may be provided on contact holders which are slidably held in the holder case, each of the movable contacts comprising a base portion inserted into and engaged with the contact holder, and a resilient contact portion connected to a rear end of the base portion along a direction of inserting into the contact holder and resiliently brought into contact with the stationary contact, the rear end of the base portion being continuously provided with a lug portion which is separated from the resilient contact portion. With such a construction, it is possible not only to facilitate the mounting of the movable contact to the stationary contact by grasping the lug portion, but also to prevent a deformation of the resilient contact portion to the utmost due to a contact with the resilient contact portion during mounting of the movable contact.

The above and other objects, features and advantages of the invention will become apparent from the following description of a preferred embodiments, taken in conjunction with the accompanying drawings.

BRIEF DESCRIPTION OF THE DRAWINGS

FIGS. 1 to 13 illustrate a preferred embodiment, wherein FIG. 1 is a plan view of a switch device;

FIG.2 is an enlarged sectional view taken along a line 2—2 in FIG. 1;

FIG.3 is an enlarged sectional view taken along a line 3—3 in FIG.2;

FIG.4 is a sectional view taken along a line 4—4 in FIG. 3;

FIG.5 is an enlarged sectional view taken along a line 5—5 in FIG. 2;

FIG. 6 is a plan view of a board assembly;

FIG.7 is a side view taken along an arrow 7 in FIG. 6;

FIG. 8 is a plan view of a printed board;

FIG. 9 is an enlarged sectional view taken along a line 9—9 in FIG. 4;

FIG.10 is a plan view of a contact holder;

FIG. 11 is a perspective view of a movable contact;

FIG. 12 is an enlarged sectional view taken along a line 12—12 in FIG. 4; and FIG.13 is a sectional view taken along a line 13—13 in FIG. 9.

DESCRIPTION OF THE PREFERRED EMBODIMENTS

The present invention will now be described by way of a preferred embodiment in connection with the accompanying drawings.

Figure 1:
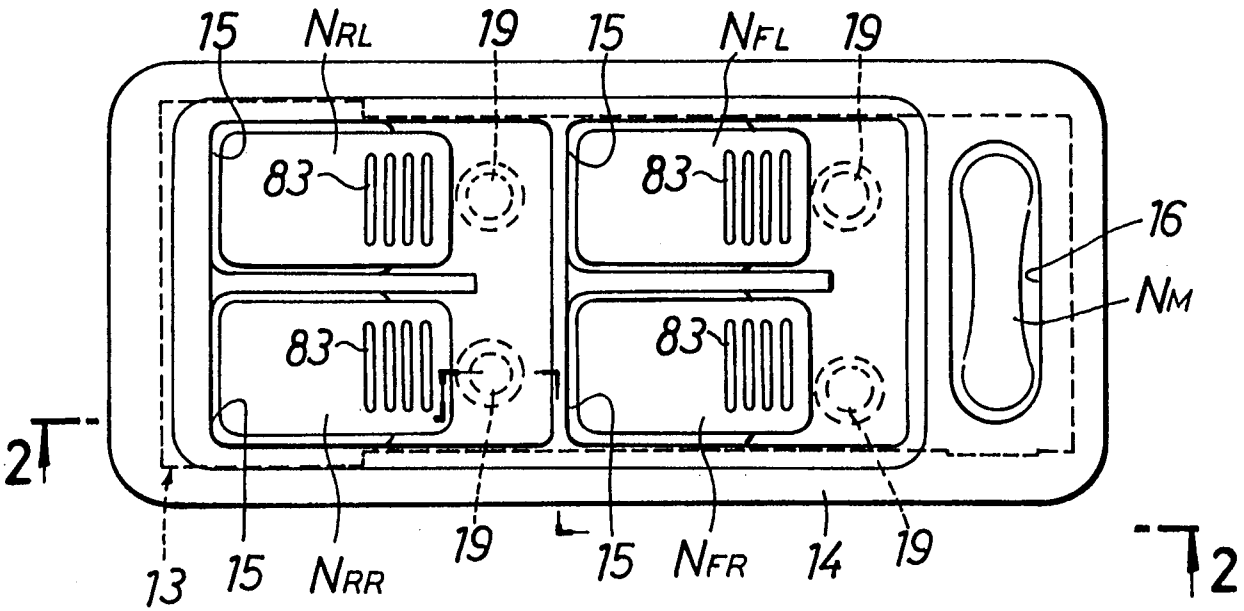
Figure 2:
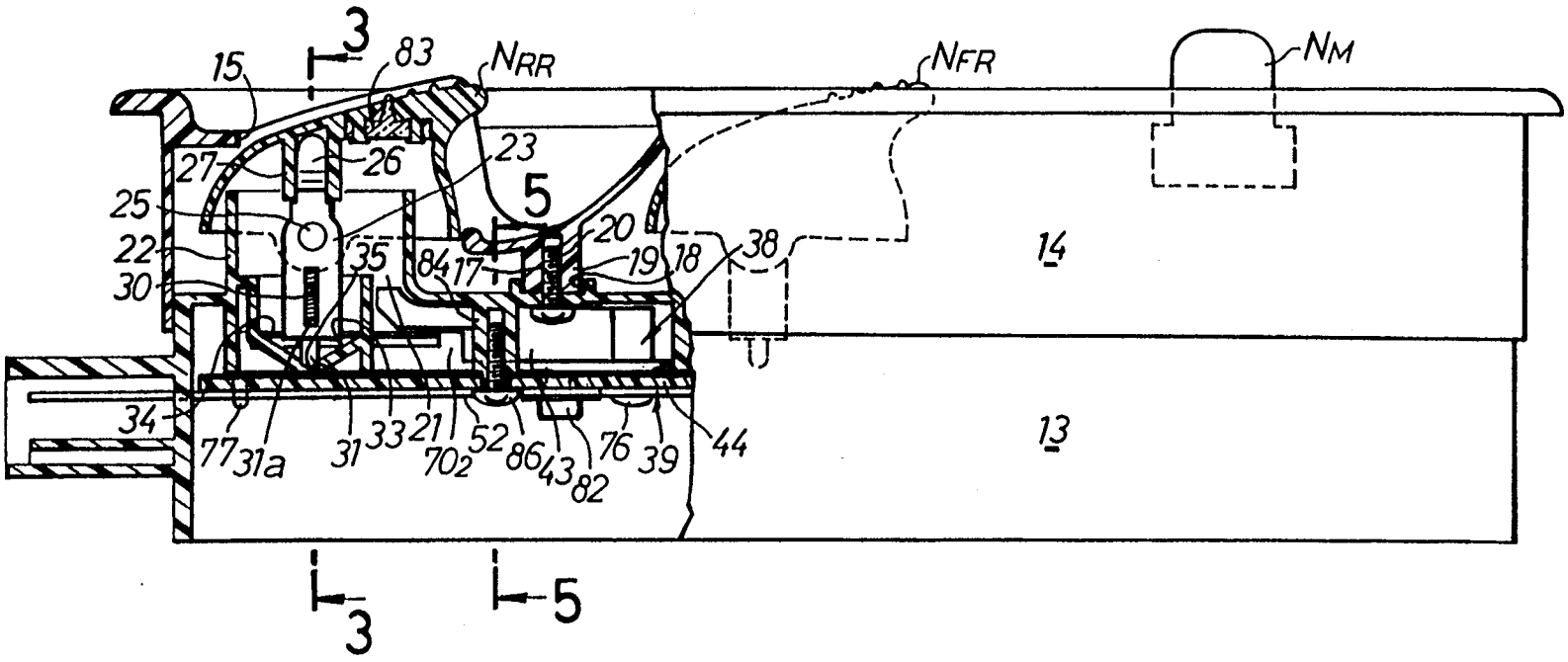

Referring first to FIGS. 1 and 2, a switch device according to the embodiment is a master switch for a power window disposed in a driver-side door in an automobile. A window glass pane in a driver-side door, e.g., a right front door is capable of being lifted and lowered by an operation of a first knob $N_{FR}$, and a window glass pane in a left front door is capable of being lifted and lowered by an operation of a second knob $N_{FL}$. A window glass pane in a right rear door is capable of being lifted and lowered by an operation of a third knob $N_{RR}$, and a window glass pane in a left rear door is capable of being lifted and lowered by an operation of a fourth knob $N_{RL}$. An operation of a fifth knob $N_M$ enables a switch-over between a state in which the window glass panes in the doors can be independently lifted and lowered, and a state in which the independent lifting and lowering of the window glass panes in all the doors excluding the driver-side door are prohibited.

Figure 3:
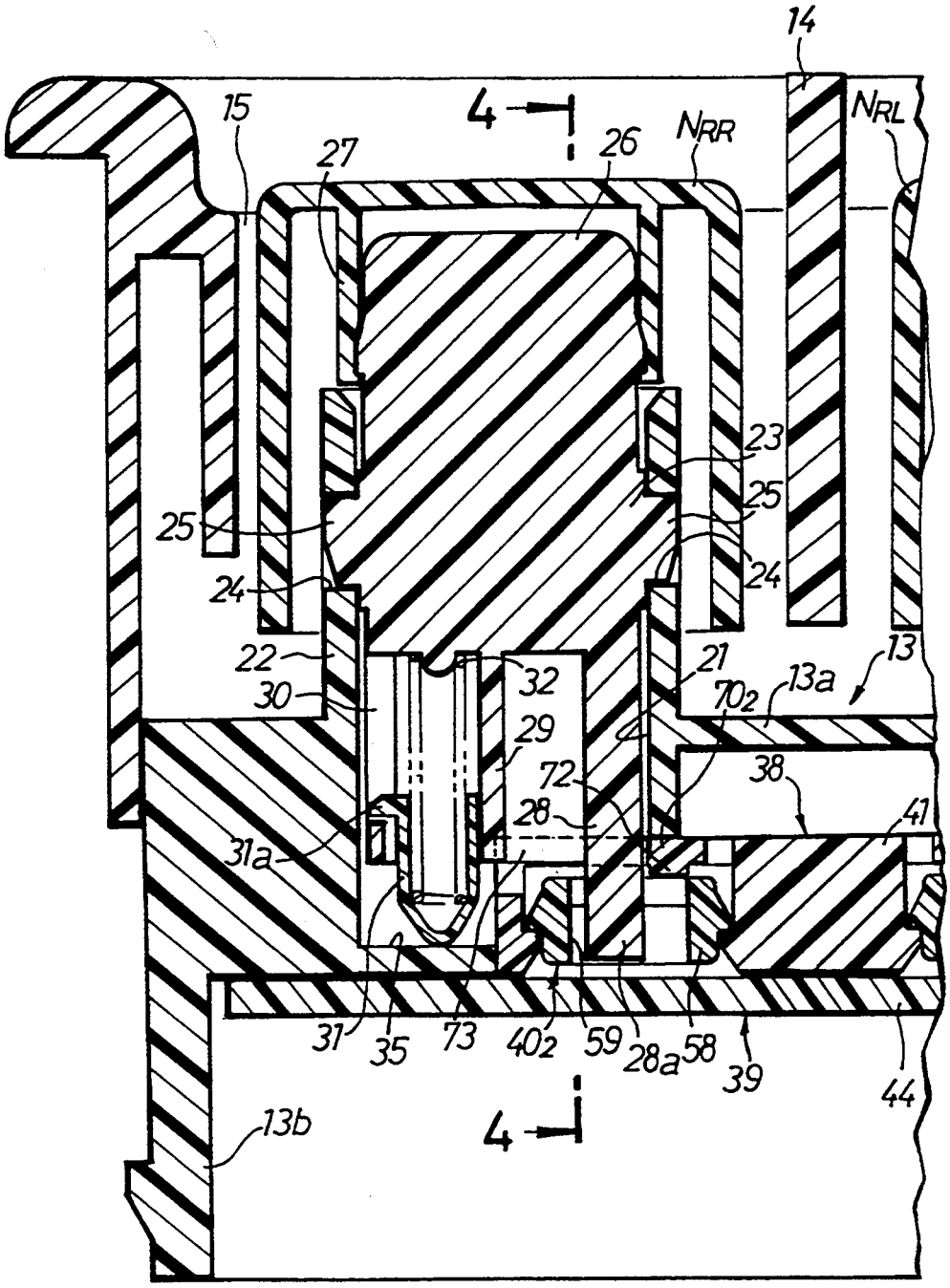
Figure 4:
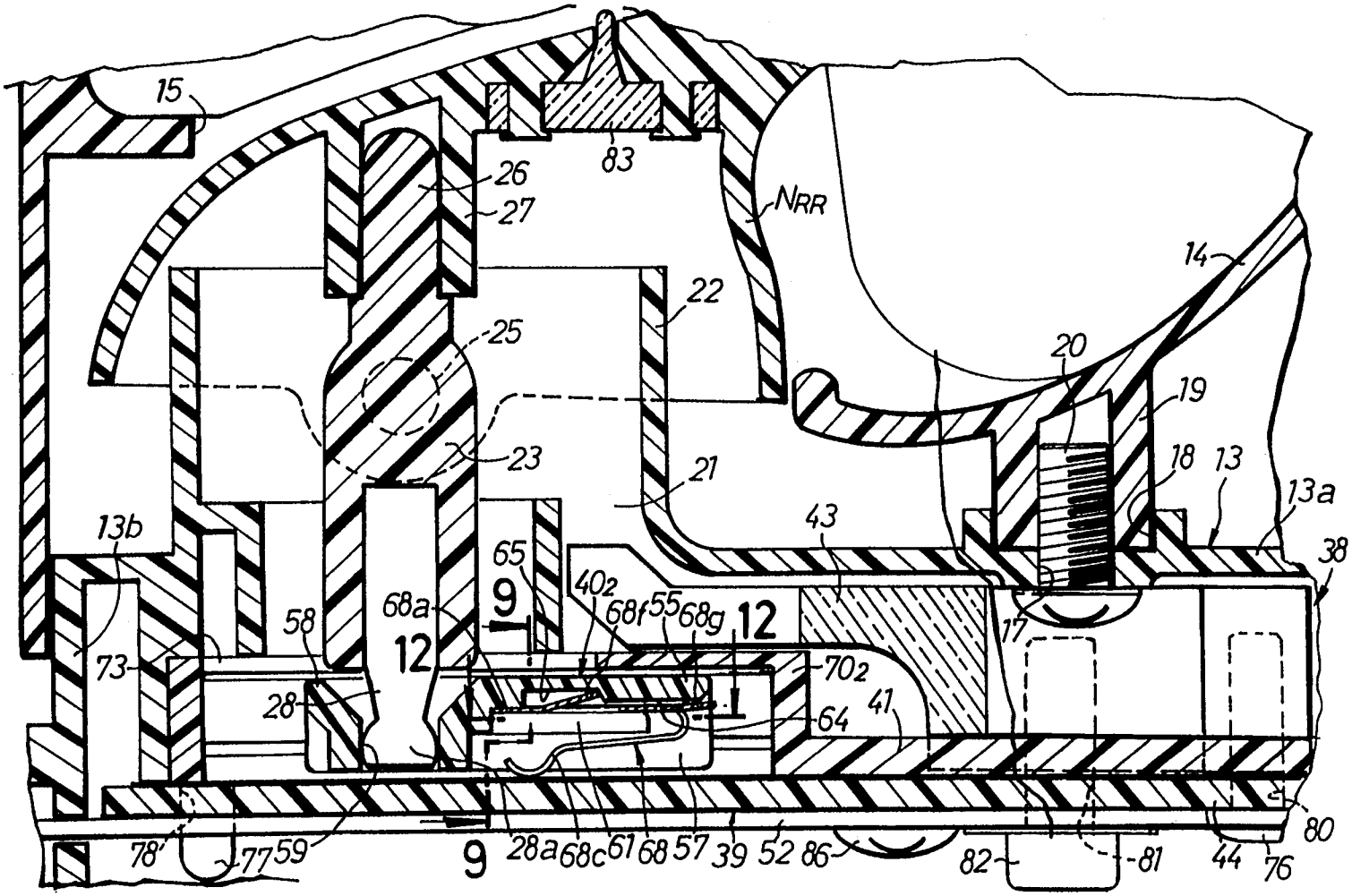

Referring also to FIGS. 3 and 4, a casing 13 is mounted to the driver-side door (not shown) and formed from synthetic resin into a rectangular box-like shape having a longer side in a longitudinal direction of the automobile. The casing 13 includes a wall 13*b* connected to a peripheral edge of a support plate portion 13*a* and mounted to the driver-side door such that the support plate portion 13*a* is directed upwardly. A garnish 14 made of synthetic resin formed into a rectangular box-like shape is fixed to the casing 13 so as to cover the support plate portion 13*a*. The garnish 14 is provided with four operating openings 15 which face the first to fourth knobs $N_{FR}$ to $N_{RL}$, respectively, and an operating opening 16 which faces the fifth knob $N_M$.

Four insertion bores 17 are provided in the support plate portion 13*a* in the casing 13. Four recesses 18 are provided on an upper surface of the support plate portion 13*a* to surround the insertion bores 17, respectively. Four legs 19 are provided on the garnish 14 to extend toward the support plate portion 13*a*. With lower ends of the legs 19 fitted into the corresponding recesses 18, screw members 20 inserted through the insertion bores 17 from the below of the support plate portion 13*a* are screwed into the legs 19, respectively. This ensures that the garnish 14 is fixed to the casing 13 with an upper portion of the casing 13 fixed to a lower portion of the garnish 14.

Rectangular openings 21 each having a longer side in a longitudinal direction of the casing 13 are provided in the support plate portion 13*a* in correspondence to the operating openings 15 in the garnish 14. And support sleeves 22 having a rectangular cross-section are integrally provided on the support plate portion 13*a* to extend upwardly to surround the openings 21. An operating member 23 is carried on each of the support sleeves 22 for tilting movement in the longitudinal direction of the automobile. More specifically, a pair of support holes 24, 24 are provided on opposite sides of the support sleeve 22 in a widthwise direction of the casing 13. The operating member 23 is fitted in the support sleeve 22 by a resilient force, until a pair of projections 25, 25 integrally provided on opposite sides of the operating member 23 are fitted into the support holes 24, 24.

The operating member 23 has an upwardly extending fitting projection 26 integrally provided on an upper portion thereof. The fitting projection 26 is fitted into and locked in a fitting sleeve 27 provided in each of the first to fourth knobs $N_{FR}$, $N_{FL}$, $N_{RR}$ and $N_{RL}$ which are disposed in the corresponding operating openings 15 in the garnish 14 to cover the upper portions of the support sleeves 22. Thus, the first to fourth knobs $N_{FR}$, $N_{FL}$, $N_{RR}$ and $N_{RL}$ are connected to the operating members 23, so that the operating members 23 are tilted longitudinally by operating the first to fourth knobs $N_{FR}$, $N_{FL}$, $N_{RR}$ and $N_{RL}$ facing the operating openings 15, respectively.

The operating member 23 is integrally provided at its lower end with a locking rod 28 extending downwardly and having a semi-spherical locking portion 28*a*, and with a guide sleeve 29 extending downwardly and having a rectangular cross-section. A vertically extending elongated hole 30 is provided in one side of the guide sleeve 29. A bottomed cylindrical follower piece 31 provided at an upper end thereof with a locking projection 31*a* adapted to be locked in the elongated hole 30 is slidably fitted in each of the guide sleeves 29 such that a rounded closed end of follower piece 31 is directed downward. A spring 32 is compressed between an upper end closed portion of the guide sleeve 29 and the follower piece 31. Thus, the follower piece 31 is biased by the spring to project downwardly out of the guide sleeve 29, and prevented from falling fallen out of the guide sleeve 29 by the locking projection 31*a* locked into a lower end of the elongated hole 30.

In correspondence to each of the second to fourth knobs $N_{FL}$, $N_{RR}$ and $N_{RL}$ for lifting and lowering the window glass panes in the left front door, the right rear door and the left rear door, a forwardly ascending slant 33 and a rearwardly ascending slant 34, with which a lower end of the follower piece 31 is brought into sliding contact, are provided on the casing 13, so that they are connected to each other at a connection portion 35 in a substantially V-shaped configuration, as shown in FIG.2. If a front end of each of the second to fourth knobs $N_{FL}$, $N_{RR}$ and $N_{RL}$ is pushed downwardly, the corresponding operating member 23 is tilted to bring the lower end of the follower piece 31 into sliding contact with the rearwardly ascending slant 34, thereby compressing the spring 32. If the front end of each of the second to fourth knobs $N_{FL}$, $N_{RR}$ and $N_{RL}$ is pulled upwardly, the corresponding operating member 23 is tilted to bring the lower end of the follower piece 31 into sliding contact with the forwardly ascending slant 33, thereby compressing the spring 32. Therefore, if the front end of each of the second to fourth knobs $N_{FL}$, $N_{RR}$ and $N_{RL}$ is operated either downwardly or upwardly, the spring 32 increases the spring force by the compression thereof. If a driver releases his hand from each of the knobs $N_{FL}$, $N_{RR}$ and $N_{RL}$, the operating member 23 is promptly returned to a neutral position in which the follower piece 31 is in sliding contact with the connection 35 between both the slants 33 and 34.

Rearwardly and forwardly ascending slants (not shown) are provided on a section corresponding to the first knob $N_{FR}$ for lifting and lowering the window glass pane in the driver-side door. These slants are adapted to, in a detent way, tilt the operating member 23 at two stages in response to the pulling-up and pushing-down operations of the front end of the first knob $N_{FR}$, but the operation of the first knob $N_{FR}$ is the same as the operations of the second to fourth knobs $N_{FL}$, $N_{RR}$ and $N_{RL}$ , and if the driver or passenger lifts his or her hand from the first knob $N_{FR}$, the operating member 23 is returned to its neutral portion.

Figure 5:
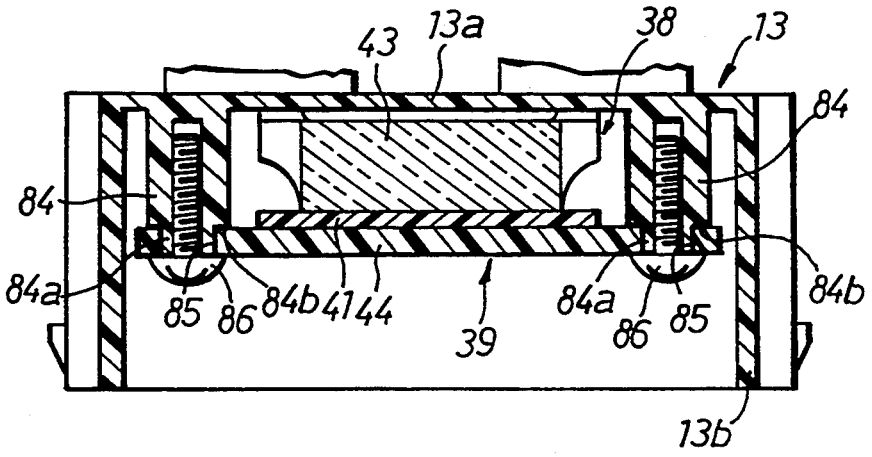
Figure 6:
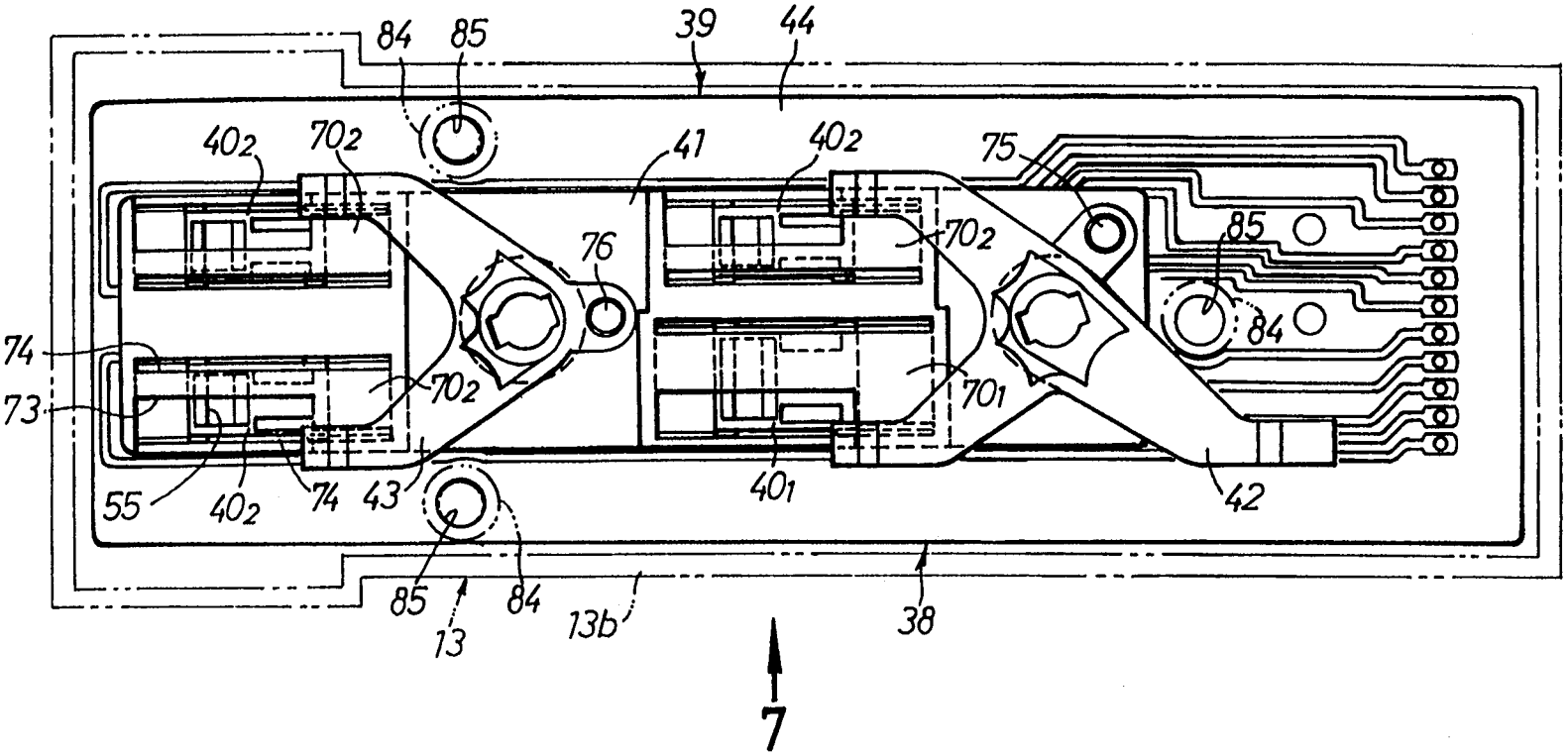
Figure 7:
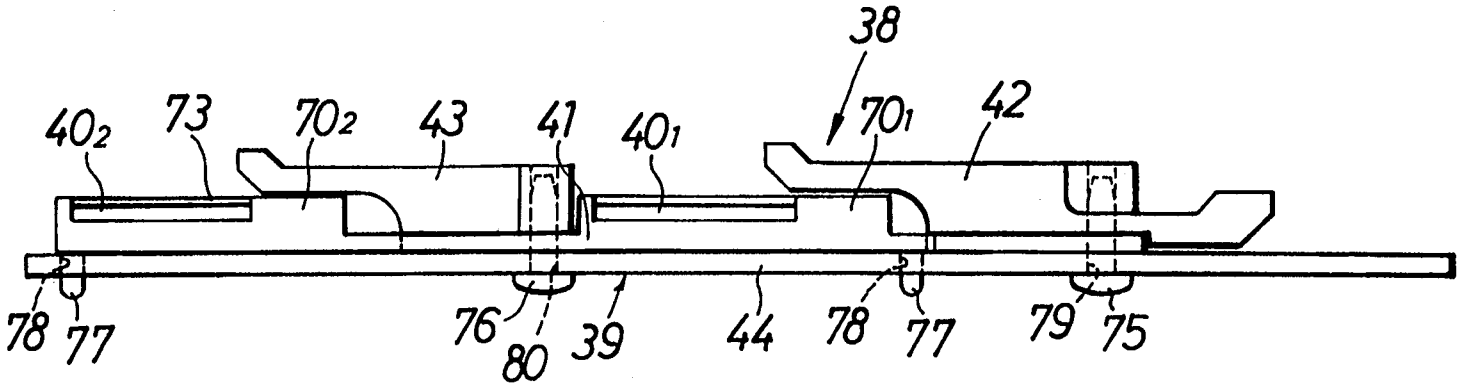

Referring also to FIGS. 5, 6 and 7, a board assembly 38 is fixedly disposed within the casing 13. The board assembly 38 includes a printed board 39, a synthetic resin contact holder $40_1$ connected to one of the four operating members 23 corresponding to the driver-side door, as well as three synthetic resin contact holders $40_2$ connected to the remaining operating members 23, respectively, a synthetic resin contact holder case 41 which retains the contact holders $40_1$ and $40_2$ for reciprocal movement in a lengthwise direction of the printed board 39 and which is positioned on and connected to the printed board 39, and a pair of synthetic resin light guides 42 and 43 fixed to the printed board 39 along with the holder case 41. The printed board 39 is positioned in and fixed to the casing 13.

Figure 8:
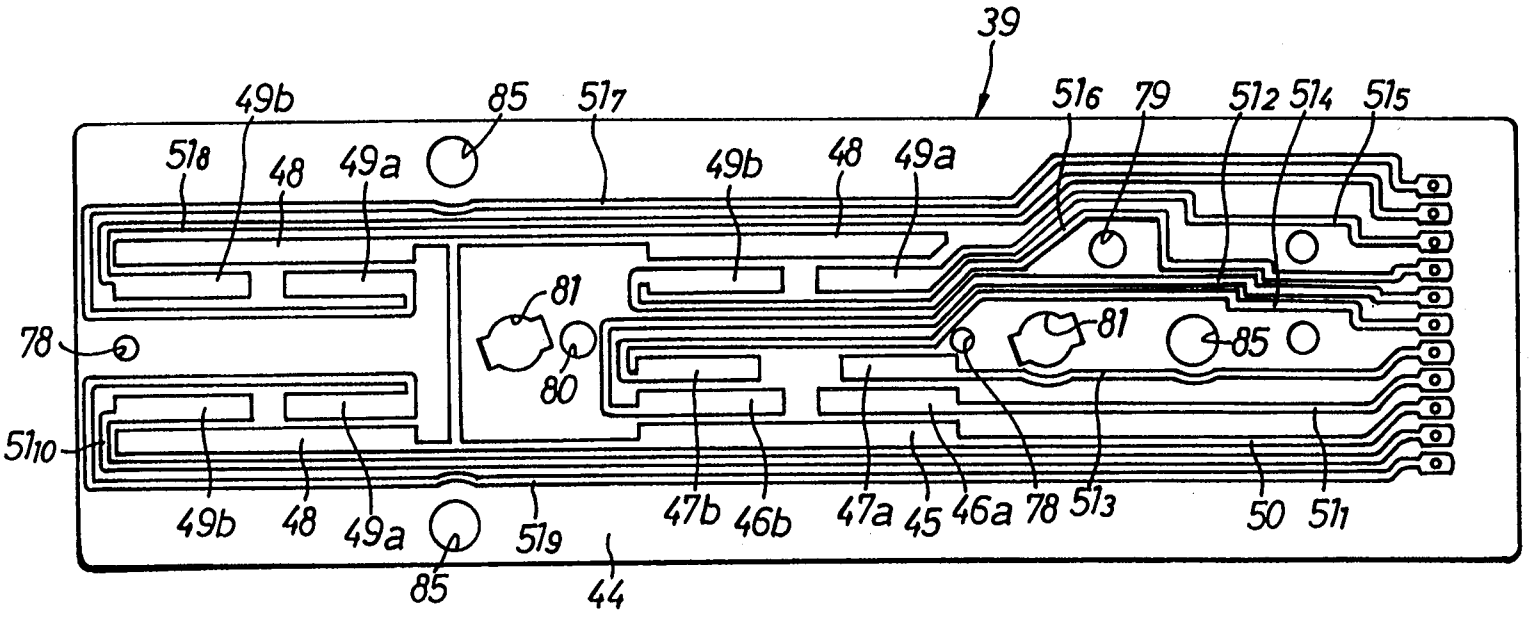

As shown in FIG. 8, the printed board 39 includes printed wires formed on a surface of an insulating substrate 44 by a deposition of an electrically conductive metal. The insulating substrate 44 is formed into a rectangular shape longer in the lengthwise direction of the casing 13 to have a contour smaller than a contour of an inner surface of the wall 13*b* of the casing 13. More specifically, formed on the surface of the insulating substrate 44 are a common stationary contact 45 corresponding to the driver-side door, a pair of separate stationary contacts 46*a* and 46*b* disposed at a distance from each other and adjacent the common stationary contact 45, a pair of separate stationary contacts 47*a* and 47*b* disposed at a larger distance from each other than the distance between the separate stationary contacts 46*a* and 46*b* and adjacent the stationary contacts 46*a* and 46*b*, three common stationary contacts 48 as well as three sets of pairs of separate stationary contacts 49*a* and 49*b* disposed at a distance from each other and adjacent the common stationary contacts 48 in correspondence to the left front door, the right rear door and the left rear door, a conductor wire portion 50 commonly leading to the common stationary contacts 45 and 48, and conductor wire portions $51_1$ to $51_{10}$ independently leading to the separate stationary contacts 46*a*, 46*b*, 47*a*, 47*b*, 49*a* and 49*b*.

Each of the stationary contacts 45, 46*a*, 46*b*, 47*a*, 47*b*, 48, 49*a*, 49*b*—is formed longer in a lengthwise direction of the insulating substrate 44.

Conductor wires 52 disposed below the insulating substrate 44 are independently connected to the conductor wire portions 50, $\mathbf{51}_1$ to $\mathbf{51}_{10}$ and drawn outside the casing 13.

Figure 9:
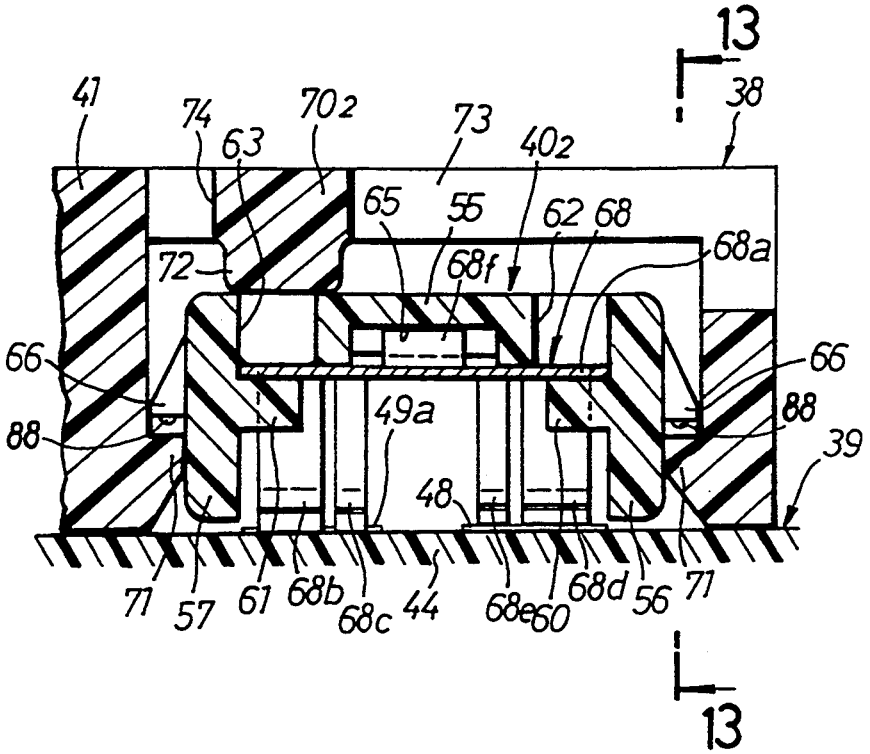
Figure 10:
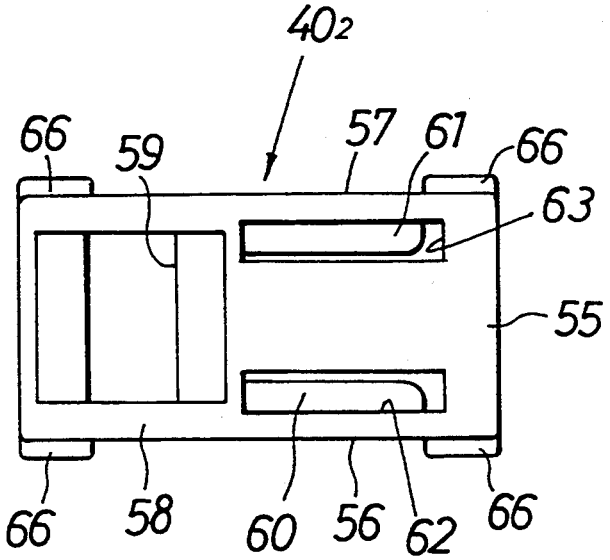

Referring also to FIGS. 9 and 10, each of the contact holders $\mathbf{40}_1$ and $\mathbf{40}_2$ is formed to have a rectangular contour and includes an upper plate portion 55 opposed to the printed board 39, a pair of side plate portions 56 and 57 connected to widthwise opposite ends of the upper plate portion 55 and extending toward the printed board 39, and a connection 58 connected to one end of the upper plate portion 55 and the side plate portions 56 and 57. The connection 58 is provided with a locking hole 59. The semispherical locking portion 28*a* at the lower end of the locking rod 28 of the operating member 23 is brought into swingable engagement with the locking hole 59, whereby the contact holders $\mathbf{40}_1$ and $\mathbf{40}_2$ are reciprocally moved within the holder case 41 in response to the tilting operation of the operating member 23 responsive to the operation of each of the first to fourth knobs $N_{FR}$, $N_{FL}$, $N_{RR}$ and $N_{RL}$.

Collar portions 60, 61 are provided on inner surfaces of the side plate portions 56 and 57 adjacent the upper plate portion 55 to project toward each other, and in order to enable the formation of the collar portions 60 and 61 during formation of the contact holders $\mathbf{40}_1$ and $\mathbf{40}_2$ in a mold, the upper plate portion 55 is provided with punched holes 62 and 63 corresponding to the collar portions 60 and 61. An inner surface of the upper plate portion 55 is provided with a guide groove 64 opened at an outer end opposite from the connection 58, as shown in FIG. 4, and with a locking recess 65 leading to an inner end of the guide groove 64. Two sets of pairs of projected portions 66 are provided at a distance from each other on opposite outer surfaces of each of the rectangular contact holders $\mathbf{40}_1$ and $\mathbf{40}_2$.

A movable contact 68 is mounted to each of the three contact holders $\mathbf{40}_2$ independently corresponding to the left front door, the right rear door and the left rear doors, respectively.

Figure 11:
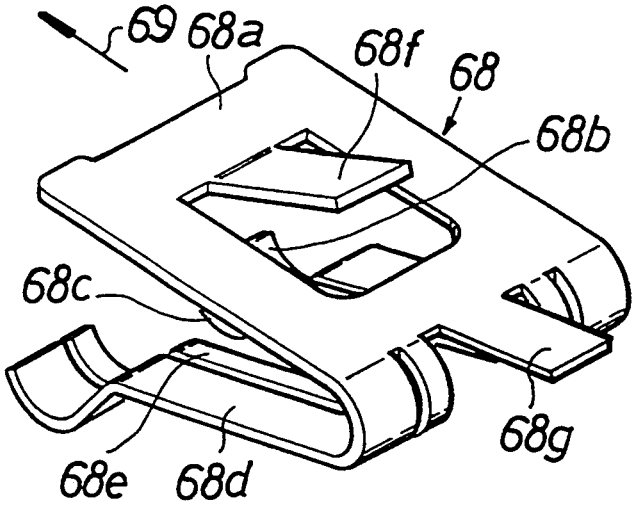
Figure 12:
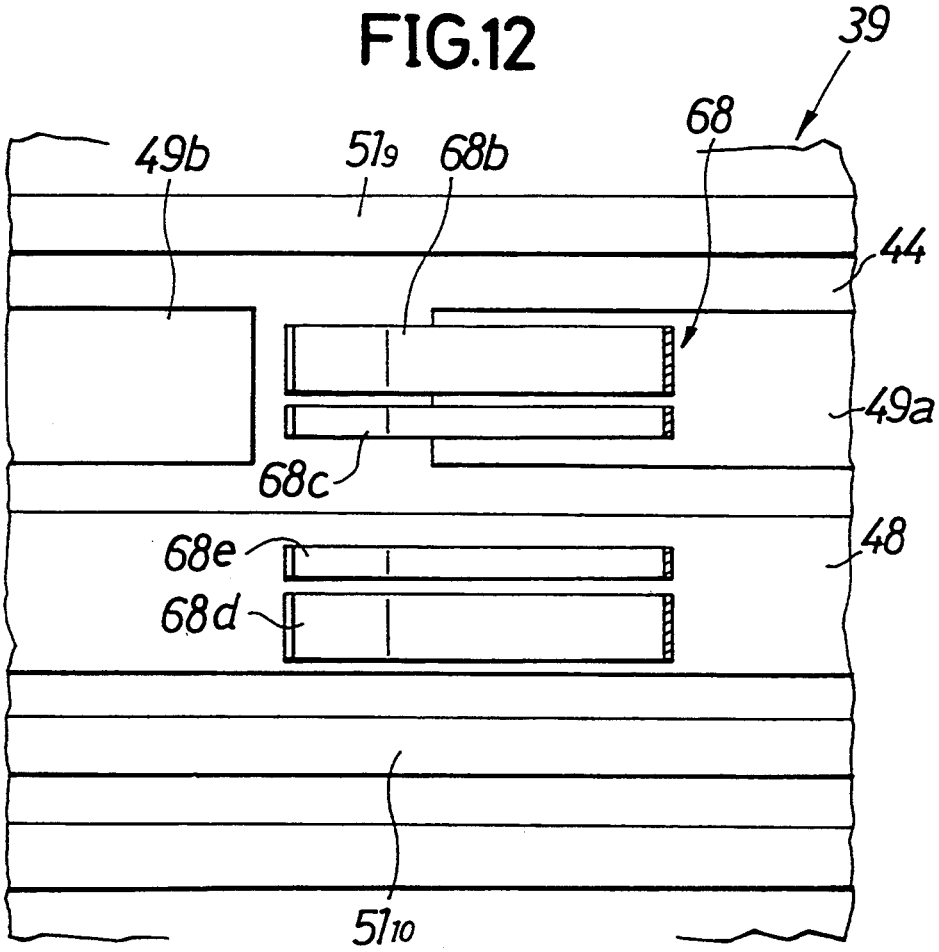

As shown in FIGS. 11 and 12, the movable contact 68 is formed from a leaf spring material, and includes a base portion 68*a* inserted between the upper plate portion 55 of the contact holder $\mathbf{40}_2$ and the collar portions 60 and 61, a pair of first resilient contact portions 68*b* and 68*c* continuously provided with to the base portion 68*a* and capable of being selectively brought into sliding contact with the separate stationary contacts 49*a* and 49*b*, a pair of second resilient contact portions 68*d* and 68*e* continuously provided with the base portion 68*a* to always come into sliding contact with the common stationary contact 48, a resilient locking portion 68*f* connected to the base portion 68*a* to resiliently come into engagement with the locking recess 65 in the contact holder $\mathbf{40}_2$, a lug portion 68*g* continuously provided with the base portion 68*a* between the two sets of pairs of first and second resilient contact portions 68*b* and 68*c*; 68*d* and 68*e*.

The base portion 68*a* is formed into a hollow quadrilateral shape. On the other hand, the two sets of pairs of first and second resilient contact portions 68*b*, 68*c*, 68*d* and 68*e* are continuously provided with opposite sides of the rear end of the base portion 68*a* in a direction 69 (see FIG.11) of inserting of the base portion 68*a*into the contact holder $\mathbf{40}_2$, so that they are curved toward the printed board 39. Tip ends of the first and second resilient contact portions 68*b*, 68*c*, 68*d* and 68*e* are resiliently brought into contact with the printed board 39. The resilient contact portions 68*b* and 68*d* are formed wider than the resilient contact portions 68*c* and 68*e* and thus, have a spring constant different from that of the resilient contact portions 68*c* and 68*e*.

The resilient locking portion 68*f* is inclined, such that as it approaches rearward of the inserting direction 69, the resilient locking portion 68*f* approaches the upper plate portion 55 of the contact holder $\mathbf{40}_2$. When the base portion 68*a* is inserted between the upper plate portion 55 and the collar portions 60 and 61, of the contact holder $\mathbf{40}_2$, the resilient locking portion 68*f* is guided in a flexed state thereof within the guide groove 64 in the upper plate portion 55 into the locking recess 65 and resiliently locked in the locking recess 65. This causes the movable contact 68 to be fixed to the contact holder $\mathbf{40}_2$.

The lug portion 68*g* is continuously connected to the rear end of the base portion 68*a* as viewed in the inserting direction 69 between the two sets of pairs of first and second resilient contact portions 68*b* and 68*c*; 68*d* and 68*e* and is inclined slightly, so that a more rear portion thereof as viewed in the inserting direction 69 assumes a higher position. The length of the lug portion 68*g* is set at a value such that the lug portion 68*g* slightly projects from the contact holder $\mathbf{40}_2$, when the mounting of the movable contact 68 to the contact holder $\mathbf{40}_2$ is completed.

The movable contact mounted to the contact holder $\mathbf{40}_1$ corresponding to the driver-side door includes a pair of resilient contact portions capable of being selectively brought into sliding contact with the separate stationary contacts 46*a* and 46*b*, a pair of resilient contact portions capable of being selectively brought into sliding contact with the separate stationary contacts 47*a* and 47*b*, and a pair of resilient contact portions which are normally in sliding contact with the common stationary contact 45. Each set of the resilient contact portions have different spring constants from each other, as the movable contacts 68 do.

The holder case 41 is provided with a retaining portion $\mathbf{70}_1$ for retaining the contact holder $\mathbf{40}_1$ for sliding movement, and with three retaining portions $\mathbf{70}_2$ for retaining the three contact holders $\mathbf{40}_2$ for sliding movement.

Each of the retaining portions $\mathbf{70}_2$ is formed into a box-like configuration opened toward the printed board 39 and is provided, on opposite sides of a lower portion of an inner surface thereof, with side guide portions 71 for receiving the projected portions 66 provided in a pair on the opposite sides of the contact holder $\mathbf{40}_2$, and at an upper portion of the inner surface, with a single upper guide portion 72 abutting against an upper surface of the contact holder $\mathbf{40}_2$. Thus, the contact holder $\mathbf{40}_2$ is slidably clamped between the side guide portions 71 and the upper guide portion 72.

Figure 13:
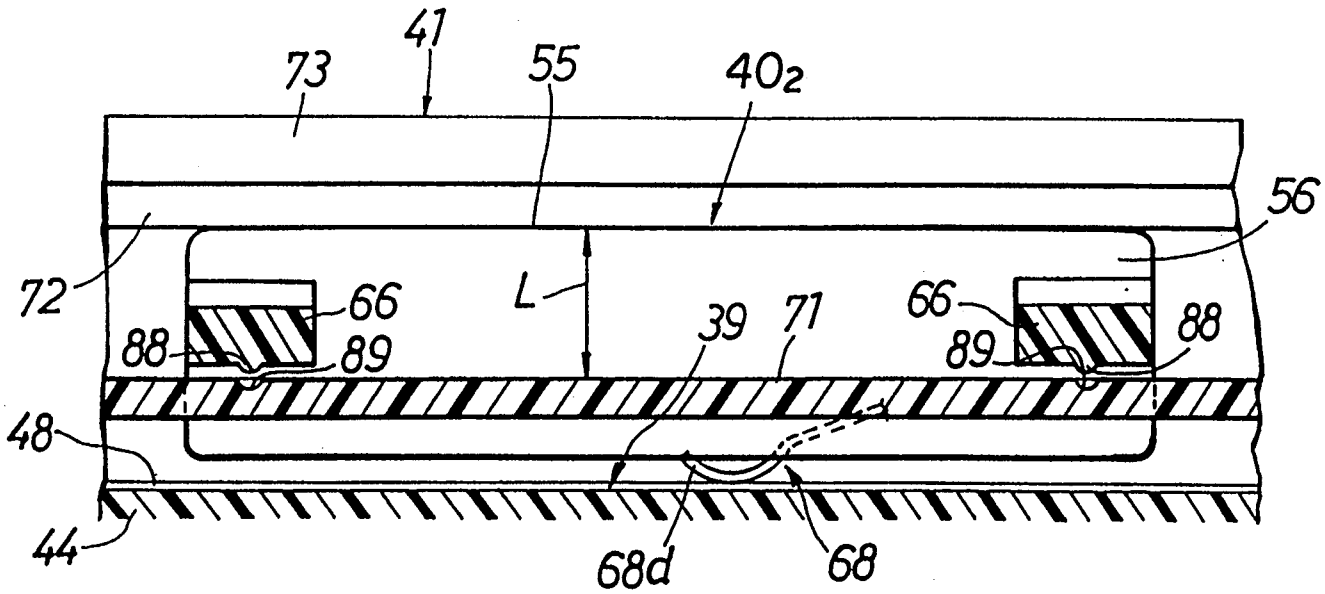

Referring also to FIG. 13, the projected portions 66 are mounted to the opposite sides of the contact holder $\mathbf{40}_2$, and a positioning projection 88 is formed on each of the projected portions 66 so as to project toward the side guide portion 71 of the holder case 41. The side guide portion 71 is provided with a plurality of positioning recesses 89 in which the positioning projections 88 can be fitted when the contact holder $\mathbf{40}_2$ is in a position where the operating members in their neutral positions can be inserted and engaged, i.e., when the contact holder $40_2$ is in its neutral position. In the holder case 41, a distance L between the upper guide portion 72 and side guide portion 71 is such that the positioning projection 88 can be disengaged from the positioning recess 89 when the contact holder $40_2$ is brought into slide contact with the upper guide portion 72.

In order to bring the semi-spherical locking portion 28*a* at the lower end of the locking rod 28 of the operating member 23 into swingable contact with the locking hole 59 in the contact holder $40_2$, an upper portion of the retaining portion $70_2$ has a through-hole 73 over a range of swinging movement of the locking rod 28, and has punched holes 74, 74 for enabling the formation of the side guide portions 71, 71 during the formation of the holder case 41 in the mold. The locking rod 28 is passed through the through-hole 73.

The retaining portion $70_1$ has basically the same construction as the retaining portion $70_2$, and the contact holder $40_1$ is slidably retained by the retaining portion $70_1$, so that it can be brought into engagement with the locking rod 28.

The light guide 42 has a shape permitting light to be guided from the inside to the fifth knob $N_M$ and the first and second knobs $N_{FR}$ and $N_{FL}$, and is clamped to an upper surface of the holder case 41 by a screw member 75 inserted from the side of the printed board 39 through the holder case 41. The light guide 43 has a shape permitting light to be guided from the inside to the third and fourth knobs $N_{RR}$ and $N_{RL}$, and is clamped to the upper surface of the holder case 41 by a screw member 76 inserted from the side of the printed board 39 through the holder case 41.

A plurality of, e.g., a pair of positioning projections 77 are provided on the holder case 41 to project toward the printed board 39. The insulating substrate 44 of the printed board 39 is provided with positioning holes 78 through which the positioning projections 77 are inserted. The positioning projections 77 and the positioning holes 78 function as positioning means for the holder case 41 and the printed board 39. The insulating substrate 44 is provided with insertion holes 79 and 80 corresponding to the screw member 75 and 76, and the screw members 75 and 76 inserted through the insertion holes 79, 80 and the holder case 41 are threadedly engaged with the light guides 42 and 43. Thus, the contact holders $40_1$ and $40_2$ are slidably retained, and the holder case 41 with the light guides attached thereto is positioned on and coupled to the printed board 39, thereby constituting the board assembly 38.

Windows 81, 81 are provided in the insulating substrate 44 at locations corresponding to the light guides 42 and 43. In a state where the board assembly 38 is attached to the casing 13, light from light emitting elements 82 and 82 disposed in the windows 81, 81 is guided via the light guides 42 and 43 to the first to fifth knobs $N_{FR}$, $N_{FL}$, $N_{RR}$, $N_{RL}$ and $N_M$. Lenses 83 for receiving light from the light guides 42 and 43 are mounted to the first to fifth knobs $N_{FR}$, $N_{FL}$, $N_{RR}$, $N_{RL}$ and $N_M$ to be exposed at outer surfaces thereof. This ensures that the position of each of the first to fifth knobs $N_{FR}$, $N_{FL}$, $N_{RR}$, $N_{RL}$ and $N_M$ can clearly be recognized even in the night.

In order to fix the board assembly 38 to the casing 13, a plurality of (preferably, three or less) bosses 84 are projectingly provided on the inner surface of the support plate portion 13*a* of the casing 13. These bosses 84 are provided at locations inwardly spaced apart from the wall 13*b* of the casing 13. A small diameter fitting shaft portion 84*a* is coaxially provided on a tip end of each of the bosses 84 with a stepped portion 84*b* interposed therebetween. The axial length of the fitting shaft portion 84*a* is set to correspond to the thickness of the printed board 39.

The insulating substrate 44 of the printed board 39 is provided with a plurality of fitting holes 85 through which the fitting shaft portion 84*a* of the bosses 84 are inserted, respectively. The printed board 39 and thus the board assembly 38 is positioned and fixed in the casing 13 by bringing screw members 86 locked at a tip end of the fitting shaft portion 84*a* and in a lower surface of the printed board 39 into threaded engagement with the bosses 84 to tighten the screw members 86, with the fitting shaft portions 84*a* of the bosses 84 fitted in the fitting holes 85 to put the stepped portions 84*b* into abutment against the printed board 39.

The operation of this embodiment will be described below. The plurality of the contact holders $40_1$ and $40_2$ are slidably retained in the holder case 41 which is positioned on and fixed to the printed board 39. Therefore, the relative positions of the common stationary contact 45, the pair of separate stationary contacts 46*a* and 46*b* and the pair of separate stationary contacts 47*a* and 47*b* with respect to the movable contact of the contact holder $40_1$ are determined definitely, and the relative positions of the common stationary contact 48, and the pair of separate stationary contact 49*a* and 49*b* with respect to the movable contact 68 of the contact holder $40_2$ are also determined definitely, thereby extremely facilitating the positioning operation.

The sliding operation of each of the contact holders $40_1$ and $40_2$ is guided in such a manner that the pair of the projected portions 66 provided on each of the opposite sides of the holders are brought into sliding contact with the side guide portions 71 of the holder case 41, and the upper surfaces thereof are brought into sliding contact with the upper guide portion 72 of the holder case 41. Therefore, the sliding contact area is relatively small, which makes it possible to minimize the sliding resistance.

In inserting the movable contact 68 to each of the contact holders $40_1$ and $40_2$ for resilient engagement with the latter, the lug portion 68*g* provided at the rear portion of the movable contact 68 as viewed in the inserting direction can be pinched by a tool such as pincers, thereby facilitating the mounting of the movable contact 68 to each of the contact holders $40_1$ and $40_2$.

When assembling the contact holders $40_1$ and $40_2$ to the holder case 41, the contact holders can be retained in their neutral positions with respect to the holder case 41 by fitting the positioning projection 88 of the contact holders in the positioning recesses 89. Then, if the holder case 41 with the contact holder $40_1$ and $40_2$ retained therein is positioned on and fixed to the printed board 39, the movable contact 68 mounted to each of the contact holders $40_1$ and $40_2$ comes into resilient contact with the upper surface of the printed board 39. The contact holders $40_1$ and $40_2$ are picked up upward by the resilient force of the movable contact 68 such that the projected portion 66 floats from the side guide portion 71 as shown in FIGS. 9 and 13. And the contact holders $40_1$ and $40_2$ are brought into slide contact with the upper guide portion 72 such that the positioning projections 88 are released from the positioning recesses 89. In this state, since the contact holders $40_1$ and $40_2$ are resiliently pushed against the upper guide portion 72, the contact holders $40_1$ and $40_2$ cannot be slid without an external force being applied to each of the contact holders $40_1$ and $40_2$. Therefore, in a state where the holder case 41 is mounted to the printed board 39 to construct the board assembly 38, the positions of the contact holders $40_1$ and $40_2$ are adjusted such that the movable contact 68 is in the neutral position, i.e., the resilient contacts 68*b* and 68*c* are in contact with the printed board 39 between both the separate stationary contacts 49*a* and 49*b*, as shown in FIG. 12. If the board assembly 38 is positioned and fixed in the casing 13 in such a condition, the semi-spherical locking portions 28*a* of the locking rods 28 connected to the corresponding first to fourth knobs $N_{FR}$, $N_{FL}$, $N_{RR}$ and $N_{RL}$ assuming their neutral positions are easily brought into engagement with the locking holes 59 under application of no external force.

Further, when the board assembly 38 is to be mounted in the casing 13, the printed board 39 is clamped to the plurality of (preferably, three or less) bosses 84 and hence, it is possible to reliably position the board assembly 38 in the casing 13 and moreover to minimize the generation of a strain in the printed board 39 as a result of tightening of the screw members 86. The printed board 39 is clamped to the plurality of bosses 84 provided on the support plate portion 13*a* at the locations inwardly spaced apart from the wall 13*b* of the casing 13, so that a gap is formed between the outer peripheral edge of the printed board 39 and the wall 13*b*. Therefore, if a load is applied to the casing 13, when the casing 13 is mounted to the door, it is possible to avoid the application of the load to the printed board 39 from the casing 13 to the utmost. Thus, in addition to the avoidance of the generation of a strain as a result of tightening of the screw members 86, it is possible to prevent a strain from being generated in the printed board 39, thereby preventing a breaking of the wire or wires in the printed portion of the printed board 39.

In such switch device, if, for example, the third knob $N_{RR}$ is operated, the contact holder $40_2$ is slid within the holder case 41, and the first resilient contacts 68*b* and 68*c* of the movable contact 68 are slid between the separate stationary contacts 49*a* and 49*b*. In this case, if there is a slight difference in level, i.e., a step between the separate stationary contacts 49*a* and 49*b* and the insulating substrate 44, the first resilient contacts 68*b* and 68*c* are moved onto and down the step. Since the first resilient contacts 68*b* and 68*c* are formed at different widths to have different spring constants, the sliding movement of at least one of the first resilient contacts 68*b* and 68*c* can be maintained without generation of a vibration and hence, a chattering cannot be generated during switching ON or OFF.

Further, as shown in FIGS. 9 and 13, if the contact holders $40_1$ and $40_2$ are slidden from their neutral positions, the projected portions 66 provided in pair on the opposite sides of each of the contact holders $40_1$ and $40_2$ float from the side guide portions 71. The sliding operation of these contact holders is guided by slidingly contacting their upper surfaces with the upper guide portion 72 of the holder case 41, in a state where the positioning projection 88 is slidingly contacted with the side guide portion 71 or floated from the side guide portion. Therefore, the sliding contact area is relatively small, and the slide resistance of the contact holders $40_1$ and $40_2$ within the holder cases 41 can be suppressed to a small level.

Although the embodiment of the present invention has been described in detail, it will be understood that the present invention is not limited to the above-described embodiment, and various modifications in design can be made without departing from the spirit and scope of the invention defined in claims.

For example, a metal piece may be secured to the insulating substrate 44 to form a stationary contact. Further, the side guide portion 71 of the holder case 41 may be provided with the positioning projection, and the projected portions 66 of the contact holders $40_1$ and $40_2$ may be provided with the recesses.

What is claimed is:

1. A switch device comprising an insulating substrate, a plurality of stationary contacts fixedly formed on the insulating substrate, a common holder case fixed to the insulating substrate, positioning means provided between said insulating substrate and said holder case for positioning the insulating substrate with respect to the holder case, a plurality of movable contact holders carrying movable contacts slidably supported in said holder case, said movable contacts being resiliently biased toward the insulating substrate and operative to move along a surface of said insulating substrate for independently contacting with and separating from the stationary contacts in a switching manner, two pairs of projected portions each pair of which is disposed at a distance from the other pair, and project from opposite sides of each of the contact holders, and guide portions provided on the holder case extending in a direction of sliding movement of each contact holder for guiding the projected portions.

2. A switch device according to claim 1, wherein said positioning means is comprised of a pair of projections provided on the holder case, and a pair of holes which are provided in the insulating substrate and in which said projections are fitted.

3. A switch device according to claim 1, further including operating members, operating knobs provided on said operating members for applying an operating force thereto, and light guides mounted on said insulating substrate for transferring light from light-emitting elements to the operating knobs to irradiate said operating knobs, said holder case and said light guides being fixed to said insulating substrate by common screw means.

4. A switch device according to claim 1, further including an upper guide portion directed toward said insulating substrate and engaging said contact holder from a side opposite said insulating substrate, one of said projected portions and said side guide portions being provided with a positioning projection projected therefrom, the other of said projected portions and said side guide portion being provided with a positioning recess in which said positioning projection is fitted so as to hold the contact holder at a predetermined position relative to the holder case wherein the operating member in its neutral position is insertable into the contact holder, and wherein a distance between said upper and side guide portions is set such that said positioning projection is disengaged from said positioning recess when said contact holder is brought into sliding contact with said upper guide portion.

5. A switch device according to claim 1, wherein said movable contacts are held by contact holders slidably carried in the holder case, and each of the movable contacts comprises a base portion fixed to said contact holder, and a plurality of resilient contact portions exhibiting a resilient force toward the insulating substrate and commonly and continuously extending from said base portion with different spring constants.

6. A switch device according to claim 1, wherein said movable contacts being carried by contact holders which are slidably held in said holder case, each of said movable contacts comprising a base portion inserted into and engaged with the contact holder, and a resilient contact portion connected to a rear end of said base portion to extend from the contact holder and being resiliently biased into contact with the stationary contact, said rear end of the base portion being provided with a lug portion continuous with said base portion and which is separated from said resilient contact portion.

7. A switch device comprising:

an insulating substrate, a plurality of stationary contacts fixedly formed on the insulating substrate, a common holder case fixed to the insulating substrate, positioning means provided between said insulating substrate and said holder case for positioning the insulating substrate with respect to the holder case, a plurality of movable contacts slidably supported in said holder case, said movable contacts being operative to move along a surface of said insulating substrate for independently contacting with and separating from the stationary contacts in a switching manner, a casing which comprises a support plate portion carried by said casing, an operating member operably connected to each of said movable contacts to impart sliding of the movable contacts in response to an operating force, and a continuous wall extending about a peripheral edge of said support plate portion, said casing including a plurality of bosses projectingly provided on an inner surface of the support plate portion and cooperating with said insulating substrate so as to be distanced from the inner surface of said wall, said insulating substrate being fixed to the bosses by screw means to define a gap between an outer peripheral edge of said insulating substrate and the inner surface of the wall of said casing.

8. A switch device according to claim 7, wherein the number of said bosses is three or less.

9. A switch device comprising:

a casing, a plurality of operating members supported in said casing, means in said casing operable to return said operating members to neutral positions thereof in response to release of an operating force on said operating members, an insulating substrate positioned and fixed on the casing, a plurality of stationary contacts formed on said insulating substrate, a plurality of movable contacts resiliently biased toward said insulating substrate for independently contacting with and separating from said stationary contacts, slidably movable contact holders individually supporting each of said movable contacts and to which said operating members are connected for bringing said stationary and movable contacts into and out of contact with each other in a switching manner in response to the operation of said operating members, and a holder case disposed on said insulating substrate and having means for guiding the sliding movement of the contact holders in response to the operation of said operating members, wherein said contact holder is provided with a body and projected portions which are projected from opposite sides of said body, said holder case being provided with a guide portion for guiding a sliding operation of said contact holder, said guide portion comprising side guide portions extending from a side of said insulating substrate in opposition to the projected portions, and an upper guide portion opposed to said contact holder body from a side thereof opposite to said insulating substrate, one of said projected portions and said guide portions being provided with a positioning projection projected therefrom, the other of said projected portions and side guide portions being provided with a positioning recess in which said positioning projection is fitted so as to hold the contact holder at a predetermined position relative to the holder case wherein the operating member in its neutral position can be inserted into the contact holder, and wherein a distance between said upper and side guide portions is set such that said positioning projection is disengaged from said positioning recess when said contact holder is brought into slide contact with said upper guide portions.

* * * * *